United States Patent [19]

Lefevre

[11] 4,199,901

[45] Apr. 29, 1980

[54] GRINDING MACHINE

[76] Inventor: François C. Lefèvre, La Chauprillade, Paslieres 63290 Puy-Guillaume, France

[21] Appl. No.: 920,971

[22] Filed: Jun. 30, 1978

[30] Foreign Application Priority Data

Jul. 8, 1977 [FR] France ..... 77 22003

[51] Int. Cl.[2] ..... B24B 3/40

[52] U.S. Cl. ..... 51/83 BS; 51/100 R; 51/216 ND

[58] Field of Search ..... 51/83 R, 83 BS, 84 R, 51/84 BS, 85 R, 85 BS, 86 R, 86 BS, 34 A, 34 BR, 94, 100 R, 113, 114, 127, 285, 216 ND, 216 H

[56] References Cited

U.S. PATENT DOCUMENTS

| | | | |
|---|---|---|---|
| 1,106,560 | 8/1914 | Hedstrom | 51/84 R |
| 1,178,400 | 4/1916 | Jones | 51/84 R |
| 1,356,737 | 10/1920 | Ramstetter . | |
| 2,222,454 | 11/1940 | Zeissl | 51/100 R |
| 2,297,827 | 10/1942 | Ellenbecker | 51/100 R |
| 2,456,482 | 12/1948 | Barnard | 51/83 R |
| 2,475,455 | 7/1949 | Nicholas | 51/83 BS |
| 2,590,042 | 3/1952 | Root | 51/94 R |
| 3,151,420 | 10/1964 | Machacek | 51/112 |
| 3,339,314 | 9/1967 | Cover . | |

*Primary Examiner*—Gary L. Smith
*Attorney, Agent, or Firm*—Irvin A. Lavine

[57] ABSTRACT

Machine for grinding given objects, such as a machine for sharpening the knives of blades, constituted by a frame, a support mounted in mobile manner on said frame, means for regulating the position of the support relative to the frame, grinding wheels mounted on one of the two members, the frame or the support, a device able to carry or hold at least one article to be ground, mounted on the other of the two said members, the frame or the support and, a device for defining a shape to be reproduced, for detecting said shape and for controlling the relative positions of said grinding wheels and said device carrying or holding at least one article to be ground. The device for the control, the definition and the detection of a shape to be reproduced has a template mounted on one of the two members, the frame or the support, and a contact sensor of said template mounted on the other of the two said members, the frame or the support, the profile of the template is contained in a plane substantially parallel to the plane of the face or faces of the articles to be ground and the point at which the sensor is in contact with the template is itself substantially contained in the plane perpendicular to the face or faces to be ground passing through the grinding zone.

7 Claims, 4 Drawing Figures

GRINDING MACHINE

BACKGROUND OF THE INVENTION

The present invention relates to grinding machines particularly for grinding the blades of knives after hardening in order to give the same their cutting edge, or after finishing operations to give the blades their final sharpening, or to effect the thickness calibration simultaneously of the two sides of a similar or corresponding member.

In the known machine for this type of work, the facing grinding wheels receive between them the blade to be ground by means of a blade holder mounted on an arm, positioned in front of the wheels and controlled by slides moved by different hydraulic or mechanical means and aligned with the arm in front of the wheels.

In this arrangement, the copying template of the profile to be made cannot be placed flush with the blade because it would receive the spraying liquid containing the suspended abradant and the metal particles from the grinding process. Therefore, in general, the template is placed between the blade holder and is therefore marked out with a different relationship from that of the considered blade profile. As a function of its spacing or remoteness point, this outline can only be empirical and imprecise relative to the true curvatures of the blade to be made, which is disadvantageous with respect to the precision of reproduction of the profile in question.

Another disadvantage is based on the fact that the free space in front of the grinding wheels is occupied by the arm and its slide, so that it is impossible to fit a revolving-type multiple blade holder. The blade is replaced when the grinding operation of the preceding blade is finished, thus increasing the machine cycle time by the time required for loading the workpiece.

Moreover, spraying liquid containing abradant and metal powder splashes and is deposited on the wheel-regulating slides, located below the work point, which causes premature wear of said slides.

Finally, on such machines, the controls are distributed over several different members which makes the same both complicated and imprecise.

BRIEF SUMMARY OF THE INVENTION

The problem of the invention is to obviate these disadvantages.

It has for its object:

a machine for grinding given objects, such as a machine for sharpening the knives of blades, constituted by:

a frame, a support mounted in mobile manner on said frame, means for regulating the position of the support relative to the frame, grinding wheels mounted on one of the two members, the frame or the support, a device able to carry or hold at least one article to be ground, mounted on the other of the two said members, the frame or the support and, a device for defining a shape to be reproduced, for detecting said shape and for controlling the relative positions of said grinding wheels and said device carrying or holding at least one article to be ground.

The device for the control, the definition and the detection of a shape to be reproduced has a template mounted on one of the two members, the frame or the support, and a contact sensor of said template mounted on the other of the two said members, the frame or the support, the profile of the template is contained in a plane substantially parallel to the plane of the face or faces of the articles to be ground and the point at which the sensor is in contact with the template is itself substantially contained in the plane perpendicular to the face or faces to be ground passing through the grinding zone.

In addition, the following advantageous arrangements are often wholly or partly adopted: The member, template or sensor, mounted on the movable support is made to bear on the other member, sensor or template, under the sole action of the weight of said movable support.

At least one of the members, template and sensor, is mounted on the corresponding part by means of a device which regulates its vertical position relative to said part.

The grinding wheels are mounted on the corresponding part at a level below the location of the template and contact sensor.

The support comprises an arm, whose one end is coupled to the frame and on whose other end is mounted one of the two components, device able to carry at least one article to be ground and the grinding wheels, the length of the arm being such that in the space between said two ends is provided a device for automatically supplying the articles to be ground of the device carrying at least one article to be ground.

The device for automatically supplying articles to be ground comprises a turret having a plurality of article holders.

BRIEF DESCRIPTION OF THE DRAWINGS

The invention is described in greater detail hereinafter relative to non-limitative embodiments and with reference to the attached drawings, wherein show.

DETAILED DESCRIPTION OF THE PREFERRED EMBODIMENTS

Figure 1:
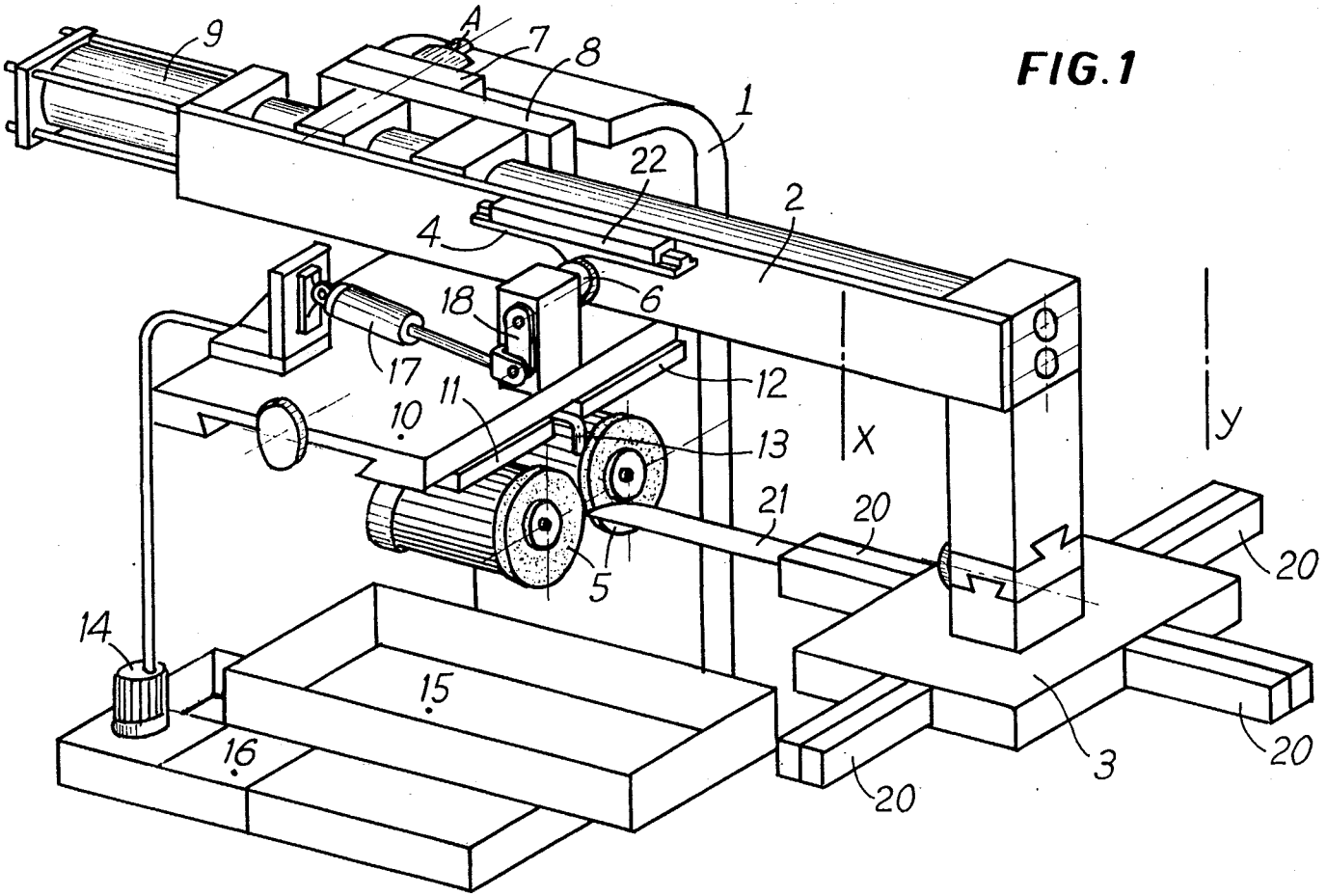
FIG. 1 a perspective view of a grinding machine according to the invention.
Figure 2:
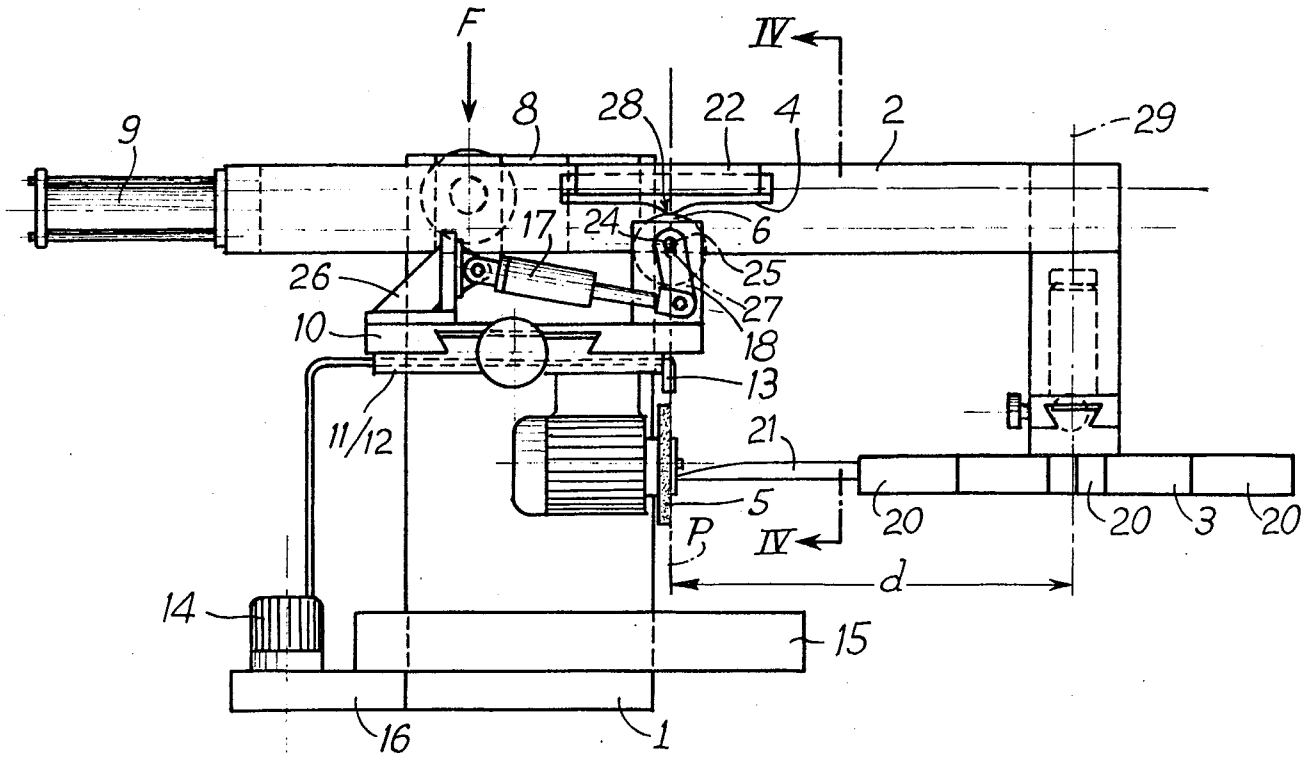
FIG. 2 a side view in elevation of the machine of FIG. 1.
Figure 3:
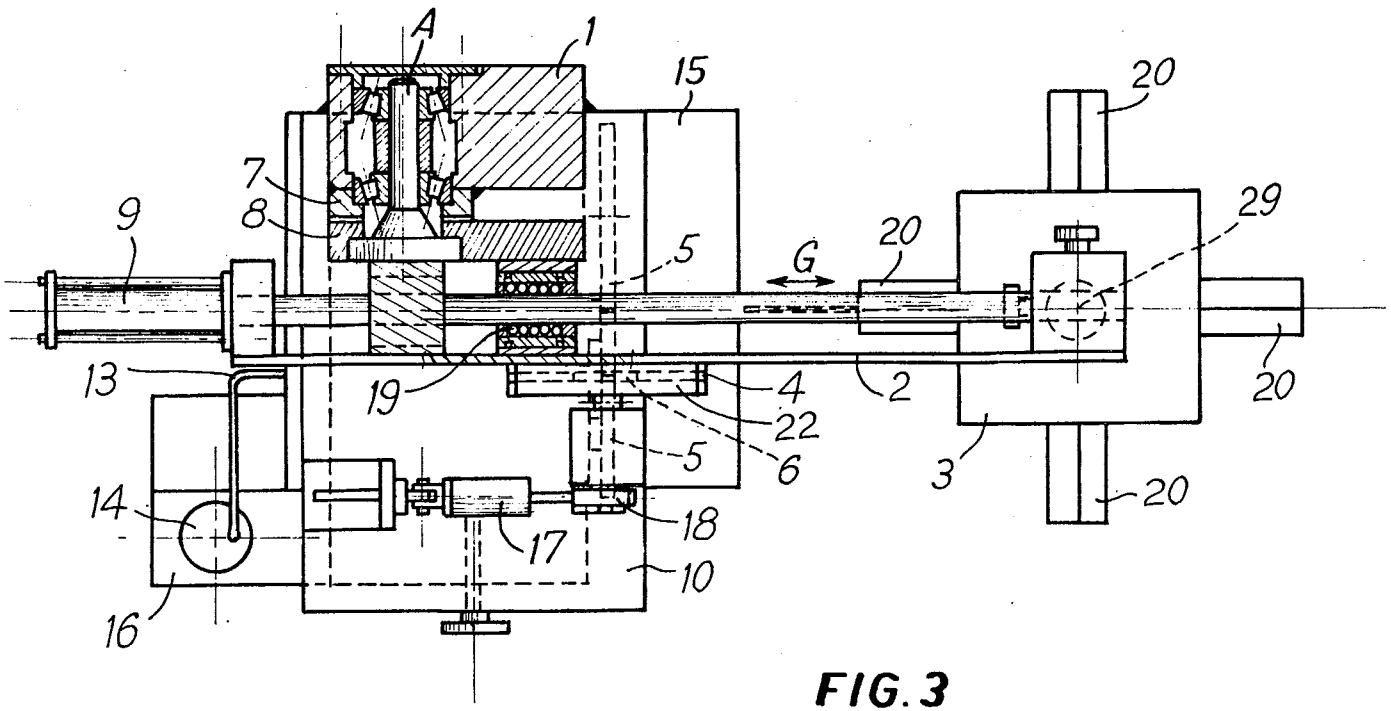
FIG. 3 a plan view in accordance with arrow F of FIG. 2 and in part section of the machine of FIG. 1.
Figure 4:
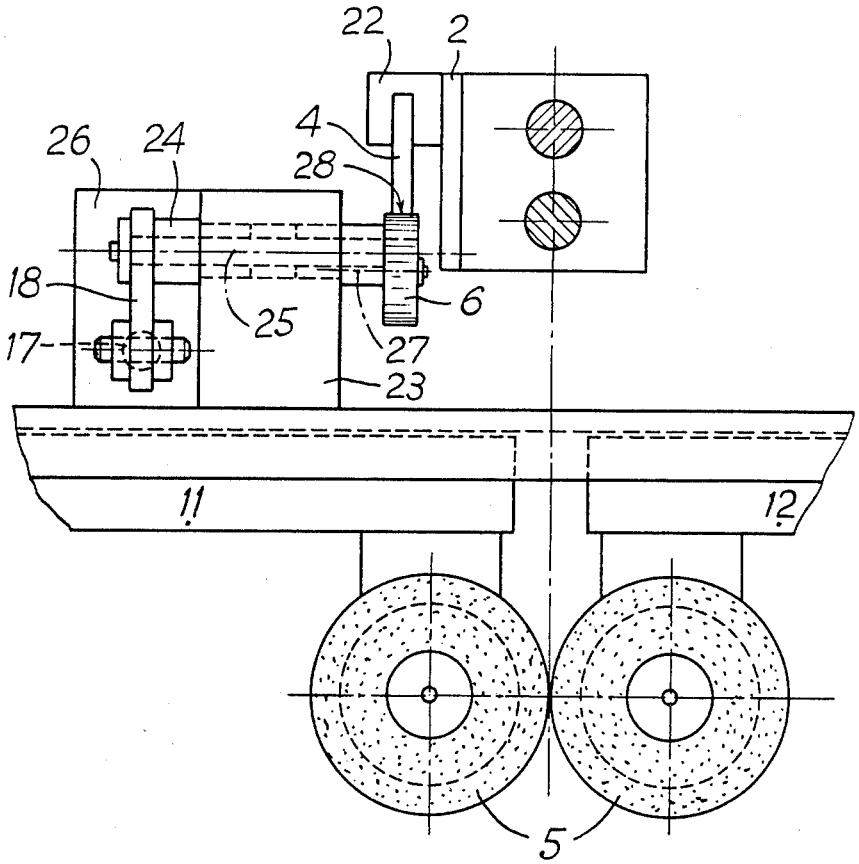
FIG. 4 a section along the line IV—IV of FIG. 2.

The grinding machine comprises a bracket 1 to which is fixed an angle plate 7. An arm 2, which is also called bow 2 due to the movement which it can effect, pivots around an axis A. To this end, arm 2 has a part 8 which pivots around axis A and relative to which is mounted in sliding manner in a direction G orthogonal to axis A the actual arm 2 by means of bearings 19. At one of its ends, arm 2 receives a jack 9 which, on starting the operating cycle, controls its retraction and on return its extension in accordance with a travel X-Y in direction G. This jack can be replaced by any other means which produces a linear movement.

To the other end of arm 2 is fixed in suspension and with the controls necessary for the good positioning of the blades to be ground 21 a capstan 3 with multiple stations 20, specifically four stations. This known capstan is controlled in the cycle by mechanical or other means and at each station is equipped with a blade holder 20, designed so as to receive the type of blade which is to be ground.

During the retraction of arm 2 in accordance with its travel X-Y and its return travel during which it performs the work, capstan 3 is stationary and in the part of the travel of arm 2 where the blade is disengaged from grinding wheels 5, capstan 3 pivots by a quarter of a turn, thus presenting another blade holder 20 in the axis of the wheels and this is repeated in each cycle. As the working movement is relatively slow, this makes it possible to place a blade 21 on the following tool holder 20, after removing that which has been previously ground. Thus, the loading time is included in the work time, so that production is increased accordingly.

The lower part of angle iron 7 receives a slide 10 which is arranged transversely relative to arm 2. Slide 10 receives two independently operable sliding members 11 and 12 to which are fixed in suspension the rotary spindles receiving the grinding wheels 5. The latter are regulated in such a way as to obtain the desired cut and are positioned on the trajectory of the blade 21 to be ground. These wheels are sprayed by tube 13, which receives the spraying liquid from pump 14. After spraying the wheels, the liquid falls into the protective casing thereof, which is not shown in the drawings in order to make the other parts visible where a recovery tank 15 is provided which is linked to a settling tank 16 where the liquid is purified and pumped again. This suspended arrangement of the machine with the main members located above it or out of reach from splashed spraying liquid provides maximum protection for the members thereof and thus greatly increases the service life of the machine and its longterm precision, said liquid flowing into the tanks without coming into contact with vital parts.

A support 22 which receives template 4 is located on the side of arm 2. By the weight of arm 2 which pivots about axis A, this template bears on a roller 6 positioned below the template.

When the arm retracts or is extended in the direction G, the template drives by contact roller 6, which idles round its axis.

The position of the axis of roller 6 can be regulated by any known means. In the represented machine, support 23 with a rotating shaft 24 is fixed to the upper face of slide 10. The geometrical axis of rotation 25 of rotary shaft 24 is parallel to axis A. On one side of support 23 a control arm 18 integral with the rotary shaft 24 is coupled to a control jack 17, whose other end is itself coupled to a support 26 fixed to slide 10. On the other side of support 23, roller 6 is fitted in rotation on rotary shaft 24 about a geometrical axis 27, which is separate from geometrical axis 25. Thus, an eccentric assembly is achieved which makes it possible to regulate the position of the geometrical axis of rotation 27 of roller 6 and in particular its height, thus permitting the regulation of the machine as a function of the type of blade 21 to be ground and/or to be sharpened.

For a given position for the geometrical axis of rotation 27 of roller 6, contact occurs between template 4 and roller 6. Taking account of the template profile, roller 6 slowly raises arm 2 into the upper position when the latter arrives at the end of its travel in front of point X, thus engaging the blade to be ground in the centre of the grinding wheels.

With the blade in the operating position, arm 2 slowly extends under the action of the jack up to a point Y. During travel X-Y template 4 always bears against roller 6, which is in the raised position. By its longitudinal profile, the template guides the osscilating movement of arm 2 from axis A in accordance with the outline of the profile copied in accordance with that which is to be affected on the blade in question.

In the latter part of the travel X-Y, capstan 3, which supports the blade holders 20, pivots by a quarter of a turn and a new blade is placed in the working axis.

The arm then retracts again from Y to X, roller 6 being lowered to permit the downward disengagement of the blade to be ground and its introduction into the centre of the grinding wheels when arm has reached point X.

The cycle is controlled by known mechanical, electrical or hydraulic means, the operation being controlled continuously or cyclically.

The present machine may utilize all known controls and automatic means which, within the cycle, aim at controlling the moving together of the grinding wheels, the compensation of their wear or the satisfactory maintenance of their cutting plane. The setting of the cutting depth can be performed by automatically moving the wheels together by a given value.

As a function of the position of the grinding wheels, the present machine can be used for the smooth grinding of blades by employing two facing cup wheels or for the thickness calibration of similar members, for example the heads of flat keys.

It may also be used to obtain the recessed cut called a "razor cut" using the represented arrangement of the grinding wheels. As a variant, cup wheels inclined by a selected angle may give the same result.

This machine may also be used for sharpening completely finished knives by eliminating the use of spraying and by providing flat grinding wheels of limited thickness, which face one another but which are staggered in the lengthwise direction by the quantity of their thickness, which makes it possible to close the cutting angle until an angle favourable for this operation is obtained.

In the latter case, the blade is flush with the junction of the wheels, whereby the metal to be removed by this operation is of very limited thickness.

Note should be taken of the following points:

the top 28 of roller 6 is positioned in the immediate vicinity of or in the transverse vertical plane P passing through the plane of wheels 5, permitting the profile of blade 21 to accurately follow that of the template by means of the roller arranged flush with and above the wheels. Grinding wheels 5 are arranged entirely below slide 10, whilst template 4 and roller 6 are permanently arranged above said slide and there is no danger of them being damaged by metal particles and/or abradants carried by the wheel spraying liquid. Arm 2 is of considerable length and is slidingly mounted in bearing 19 on angle plate 7 by one of its ends 8 and supports at its other end the capstan 3. Thus, a large space d is provided between wheels 5 and the substantially vertical rotation axis 29 of the capstan and accurately permits the operation of said capstan or some equivalent means, such as an automatic device for feeding in the blades to be ground and removing said blades.

The invention is not limited to the embodiments described and represented hereinbefore and various modifications can be made thereto without passing beyond the scope of the invention.

What is claimed is:

1. A machine for grinding, such as for sharpening knives comprising:

a first part, a second part, means for mounting the second part on the first part for linear and rotational movement relative thereto, means for moving the second part relative to said first part, grinding wheels, means for mounting said grinding wheels on one said part in substantially coplanar relation, article holding means, means for mounting said article holding means on the other said part, a template, means mounting said template on the other said part, a contact sensor engaging said template, and means mounting said contact sensor on said one part with the point of engagement thereof with said template lying substantially in the plane of said grinding wheels.

2. The machine of claim 1, wherein said template mounting means mounts said template so that a plane passing longitudinally therethrough is substantially parallel to the plane of the face or faces of an flat article held by said article holding means.

3. The machine of claim 1, wherein the weight of said second part causes engagement of the contact sensor and the template.

4. The machine of claim 1, said machine further comprising means for regulating the position of at least one of said template and contact sensor on the part on which it is mounted.

5. The machine of claim 1, said means for mounting said grinding wheels mounting said grinding wheels below said template and said contact sensor.

6. The machine of claim 1, said second part being a linearly extending arm, said mounting means therefor being adjacent one end of said arm, and said article holding means mounting means being at the other end of said arm.

7. The machine of claim 1, said article holding means comprising a turret having a plurality of article holders thereon.

* * * * *